US009045304B2

(12) United States Patent
Li et al.

(10) Patent No.: US 9,045,304 B2
(45) Date of Patent: Jun. 2, 2015

(54) SUCTION-TYPE TRANSMISSION APPARATUS

(75) Inventors: Chang-Chou Li, Tainan (TW); Kuo-Hsin Huang, Tainan (TW); Chin-Lung Liu, Kaohsiung (TW); Chih-Yu Ke, Pingtung County (TW)

(73) Assignee: INDUSTRIAL TECHNOLOGY RESEARCH INSTITUTE, Chu-Tung, Hsinchu (TW)

( * ) Notice: Subject to any disclaimer, the term of this patent is extended or adjusted under 35 U.S.C. 154(b) by 602 days.

(21) Appl. No.: 13/411,185

(22) Filed: Mar. 2, 2012

(65) Prior Publication Data

US 2013/0137560 A1 May 30, 2013

(30) Foreign Application Priority Data

Nov. 30, 2011 (TW) ..... 100144009 A

(51) Int. Cl.
*B25F 5/02* (2006.01)
*B65H 20/12* (2006.01)

(52) U.S. Cl.
CPC ..... *B65H 20/12* (2013.01); *B65H 2406/1131* (2013.01); *B65H 2406/361* (2013.01)

(58) Field of Classification Search
CPC ..... B65H 20/12; B65H 2406/361; B65H 2406/1131
USPC ..... 492/15; 162/371; 226/95; 271/264
See application file for complete search history.

(56) References Cited

U.S. PATENT DOCUMENTS 1,241,272 A * 9/1917 Phelps ..... 162/368
3,587,962 A 6/1971 Herzhoff et al.
4,277,010 A * 7/1981 Landskroener et al. ..... 226/95
4,973,385 A * 11/1990 Jean et al. ..... 162/368
5,114,062 A 5/1992 Kuhn et al.
5,554,262 A 9/1996 Turner (Continued)

FOREIGN PATENT DOCUMENTS

CN 2619968 A 6/2004
CN 201754668 3/2011

(Continued)

OTHER PUBLICATIONS

English Translation of TW 398740 U1, retrieved Sep. 2014.*

(Continued)

*Primary Examiner* — Jacob Cigna
(74) *Attorney, Agent, or Firm* — Muncy, Geissler, Olds & Lowe, P.C.

(57) ABSTRACT

A suction-type transmission apparatus includes at least one suction region allocation member and a suction wheel member. The suction region allocation member has a chamber and through holes communicating with the chamber. The suction wheel member is pivoted to the suction region allocation member, and includes an inner lining body with gas flow channels disposed in parallel, and an outer ring sleeve. The inner lining body has gas holes corresponding to the through holes and being in communication with the gas flow channels. The outer ring sleeve with micro-pores in communication with the gas flow channels is sleeved on the inner lining body, and wraps the gas flow channels. The chamber is connected to a gas extraction port, and at least one sealing element is selectively disposed in the chamber to seal at least one of the through holes for forming a suction region of the suction wheel member.

15 Claims, 10 Drawing Sheets

(56) References Cited

U.S. PATENT DOCUMENTS

| | | | | |
|---|---|---|---|---|
| 5,570,620 | A * | 11/1996 | Okonski et al. | 83/152 |
| 6,427,941 | B1 | 8/2002 | Hikita | |
| 7,654,427 | B1 | 2/2010 | Tsai et al. | |
| 2005/0082332 | A1 * | 4/2005 | White | 226/95 |
| 2007/0114109 | A1 | 5/2007 | Berndtsson et al. | |
| 2007/0175605 | A1 * | 8/2007 | Shakespeare et al. | 162/197 |
| 2009/0190979 | A1 | 7/2009 | Tanaka | |

FOREIGN PATENT DOCUMENTS

| | | | |
|---|---|---|---|
| JP | 2630870 | B2 | 7/1997 |
| JP | 2004-026348 | A | 1/2004 |
| TW | 201012722 | | 4/2010 |
| TW | I322752 | | 4/2010 |
| TW | 201020186 | | 6/2010 |
| TW | 398740 | U * | 2/2011 |
| TW | M398740 | | 2/2011 |
| TW | I356765 | | 1/2012 |

OTHER PUBLICATIONS

Zhang et al., "A Roll-to-Roll Photolithography Process for Establishing Accurate Multilayer Registration on Large Area Flexible Films," Journal of Display Technology, vol. 6, No. 11, Nov. 2010, pp. 571-578.

Krebs, "Polymer solar cell modules prepared using roll-to-roll methods: Knife-over-edge coating, slot-die coating and screen printing," Solar Energy Materials & Solar Cells, 93, Jan. 21, 2009, pp. 465-475.

Krebs, "Roll-to-roll fabrication of monolithic large-area polymer solar cells free from indium-tin-oxide," Solar Energy Materials & Solar Cells, 93, May 28, 2009, pp. 1636-1641.

Tsai, "The Flexible Substrate Real Time Alignment Technology for R2R Process," Journal of the Mechatronic Industry, Issue 307, Oct. 13, 2008, pp. 55-66.

Chuang, "The Roll to Roll Technology of Flexible Electronics Equipment," Journal of the Mechatronic Industry, Issue 307, Oct. 13, 2008, pp. 67-82.

* cited by examiner

SUCTION-TYPE TRANSMISSION APPARATUS

CROSS-REFERENCE TO RELATED APPLICATIONS

This non-provisional application claims priority under 35 U.S.C. §119(a) on Patent Application No(s). 100144009 filed in Taiwan, R.O.C. on Nov. 30, 2011, the entire contents of which are hereby incorporated by reference.

BACKGROUND

1. Technical Field

The disclosure related to a suction-type transmission apparatus, and in particular, to a transmission apparatus having a suction roller.

2. Related Art

With the advancement of technologies, the development of consumer products is changing with human demands. Since the product made by flexible electronics technology is good in flexibility, such technology is promising. Conventionally, products are made by electronic components of which the substrate is rigid, wherein the substrate is made of silicon or glass. In contrast, the flexible electronics technology is able to fabricate flexible electronic products. In order to fabricate flexible electronic products, applications of flexible substrates such as plastics, metal sheets, thin glass, cloth and paper all fall within the study scope in this field. Since the products made by the flexible electronics technology are light, thin, shock-withstand, flexible, easy for carrying, capable of being used while being bended, and having freeness in changes in shape, such technology has superiority in field of portable electronic and newly emerging products. With respect to the equipments applied in the flexible electronic technology, because materials uses by such technology are deformable, roll-to-roll processing devices are widely used. And, compared with equipment used in conventional technology, such roll-to-roll processing devices are an important improvement.

However, while flexible substrate is transported in the roll-to-roll processing device, many rollers are needed to transport or redirect the flexible substrate. Besides, an upper surface or a lower surface of the flexible substrate contacts with the rollers. However, there are many circumstances where the surface of the substrate to be further processed is not suitable for direct contacting with the rollers or being pressed. For example, the substrate which undergoes a wet process is not completely dried or solidified; the surface of the substrate has micro-structures; the coating material coated on the substrate is fragile, or some electronic circuits have been disposed on the substrate.

In order to solve the problem that the process surface of the substrate is contaminated or damaged due to a normal force applied by the rollers, a suction-type transmission roller is used to replace the normal force with a holding force. Accordingly, the problem of the flexible substrate which is pressed by the roller is overcome.

However, a roll-to-toll processing device includes a plurality of suction-type transmission roller, the suction position of one suction-type transmission roller is different from another, and the suction position of each suction-type transmission roller is fixed. Accordingly, the place where a suction-type suction roller is limited due to its fixed suction position

SUMMARY

The suction-type transmission apparatus according to the disclosure comprises at least one suction region allocation member and a suction wheel member. The suction region allocation member has a chamber and a plurality of through holes in communication with the chamber. The suction wheel member comprises a rotating shaft, an inner lining body, and an outer ring sleeve. The rotating shaft is pivoted to the suction region allocation member. The inner lining body is disposed on the rotating shaft and is laminated to the suction region allocation member. The inner lining body has a plurality of gas flow channels that are disposed in parallel, and the inner lining body has a plurality of gas holes corresponding to the through holes on a side thereof. The gas holes are disposed around the rotating shaft, and the gas holes are in communication with the gas flow channels. The outer ring sleeve is sleeved on the inner lining body, and covers the gas flow channels; and the outer ring sleeve has a plurality of micro-pores in communication with the gas flow channels. The chamber is connected to a gas extraction port, and at least one sealing element is selectively disposed in the chamber to seal at least one of the through holes, so as to form a suction region scope for the suction wheel member.

DETAILED DESCRIPTION

Figure 1:
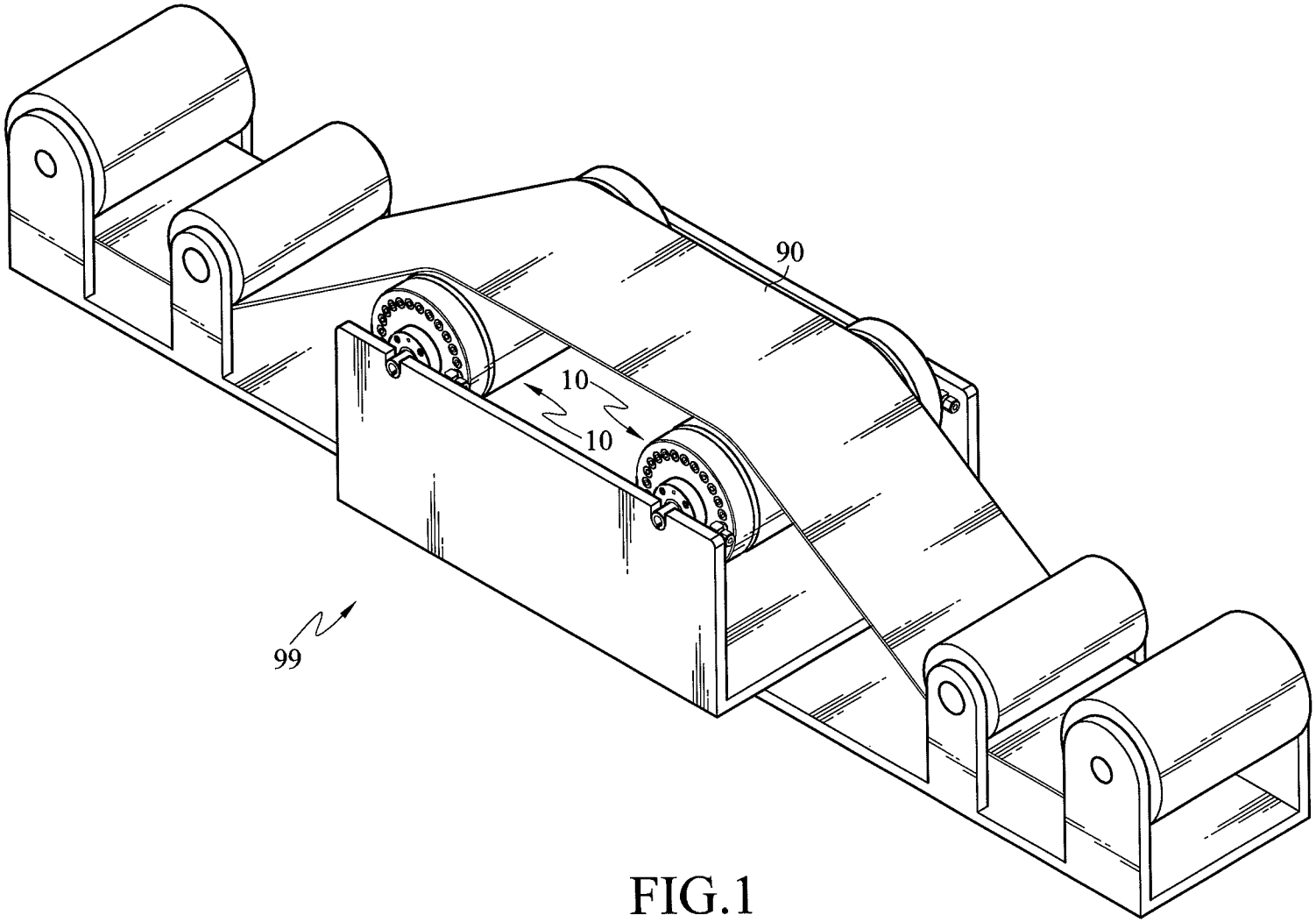
FIG. 1 is a schematic structural view of flexible substrate process equipment according to an embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

The disclosure is directed to a suction-type transmission apparatus, so as to solve the problem that a suction position of a conventional suction-type roller cannot be adjusted, and resulting in limitation in the application of the suction roller.

Figure 2A:
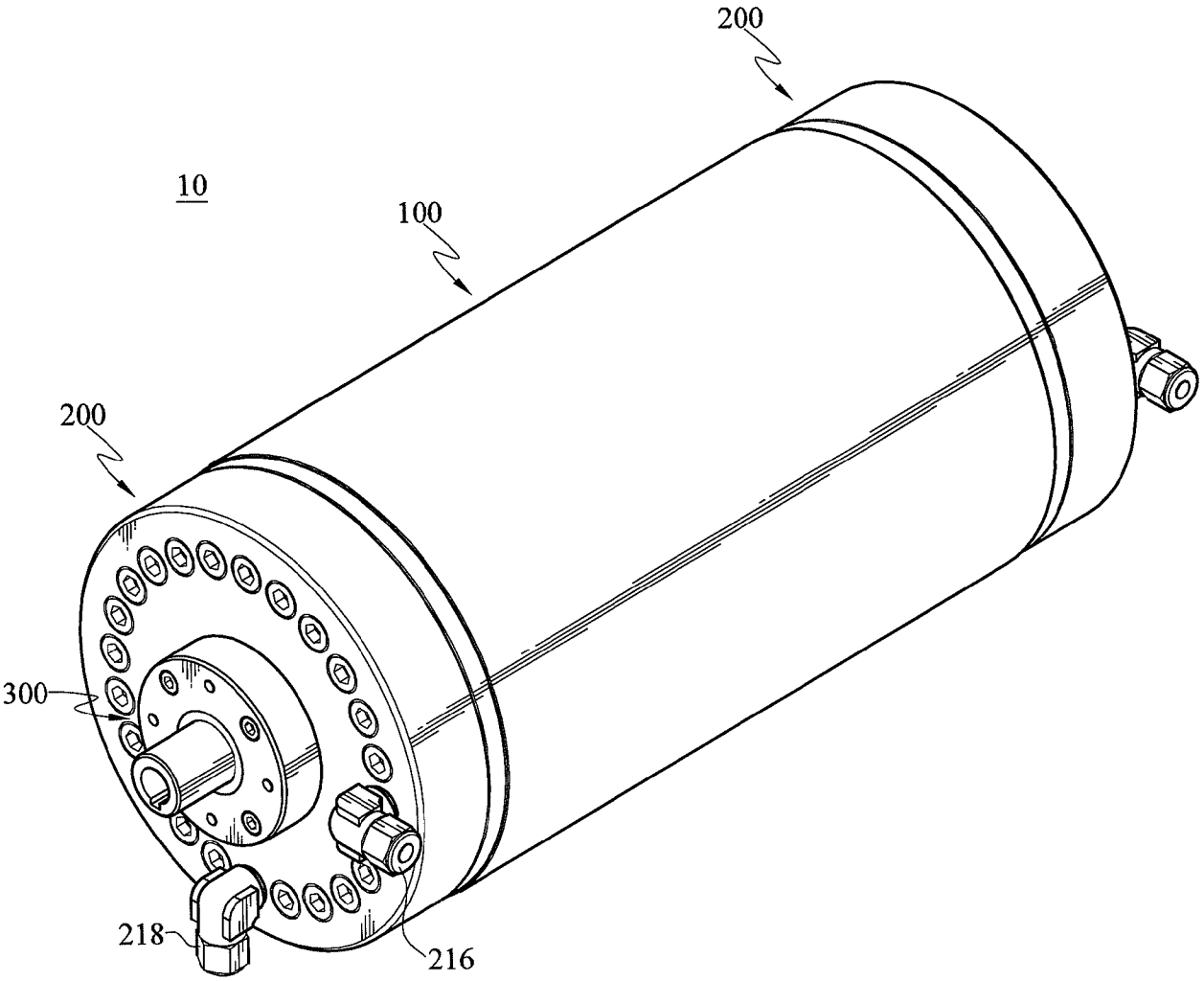
FIG. 2A is a schematic assembled structural view of a suction-type transmission apparatus according to an embodiment of the disclosure.

FIG. 1 is a schematic structural view of flexible substrate process equipment according to an embodiment of the disclosure; FIG. 2A is a schematic assembled structural view of a suction-type transmission apparatus according to an embodiment of the disclosure; and FIG. 2B is a schematic exploded structural view of a suction-type transmission apparatus according to an embodiment of the disclosure.

In some embodiments, the suction-type transmission apparatus 10 according to the disclosure is a suction-type roller apparatus, which is applicable in flexible substrate process equipment 99 of roll-to-roll processing. When a flexible substrate 90 transferred to the flexible substrate process equipment 99, the suction-type transmission apparatus 10 provides negative-pressure suction for transmitting, guiding and positioning the flexible substrate 90.

Figure 2B:
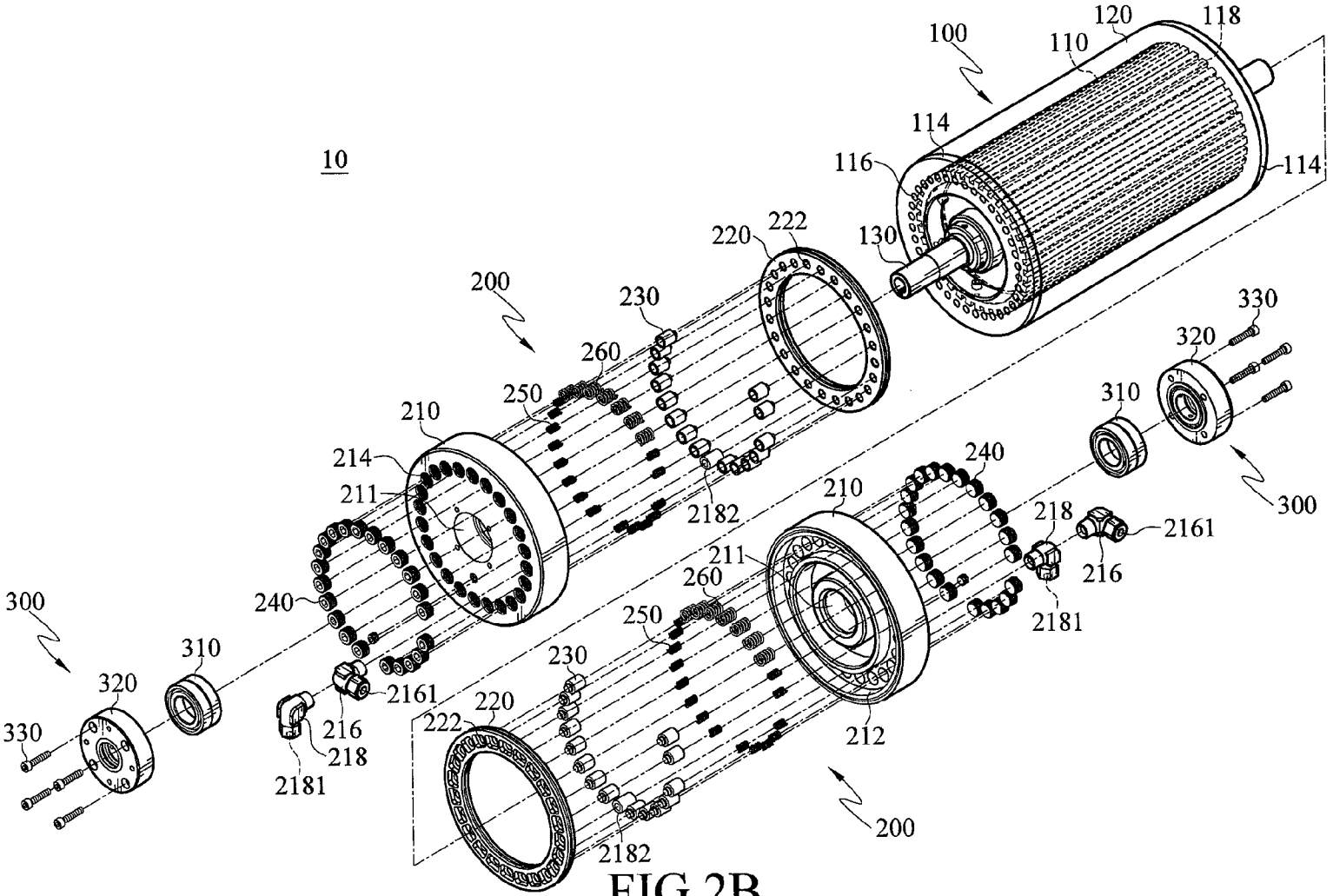
FIG. 2B is a schematic exploded structural view of a suction-type transmission apparatus according to an embodiment of the disclosure.

Referring to FIG. 2A and FIG. 2B, the suction-type transmission apparatus 10 of this embodiment comprises a suction wheel member 100 and at least one suction region allocation member 200. The suction region allocation member 200 has a chamber 212 and a plurality of through holes 222 in communication with the chamber 212. Furthermore, in this embodiment or other embodiments, the suction region allocation member 200 may further comprise a side housing 210 and a ring contact disk 220. The chamber 212 is formed by the side housing 210 and the contact disk 220 together. Specifically, a side of the side housing 210 is curved inward to form a ring groove; and the contact disk 220 is laminated to a side of the side housing 210 and covers the groove to form the chamber 212. Additionally, the through holes 222 run through the contact disk 220 to be in communication with the chamber 212. The through holes 222 may be formed on the contact disk 220 at regular interval along a ring path.

Furthermore, the suction wheel member 110 of this embodiment comprises a rotating shaft 130, an inner lining body 110, and an outer ring sleeve 120. The rotating shaft 130 is pivoted to the suction region allocation member 200. The inner lining body 110 is disposed on the rotating shaft 130 and is laminated to the contact disk 220 of the suction region allocation member 200. The inner lining body 110 is configured to rotate with respect to the suction region allocation member 200 through the rotating shaft 130. The material of the inner lining body 110 may be metal; and the inner lining body 110 has a plurality of gas flow channels 118 that are disposed in parallel. The gas flow channels 118 is formed by a surface of the inner lining body 110 that is curved inward and extends along an axial direction of the rotating shaft 130. In addition, the inner lining body 110 has a plurality of gas holes 116 at a side thereof. The gas holes 116 correspond to the through holes 222, and the number of the gas holes 116 matches the number of the gas flow channels 118 on the inner lining body 110. The gas holes 116 surround the rotating shaft 130, and each of the gas holes 116 corresponds to and is in communication with one of the gas flow channels 118.

The outer ring sleeve 120 of this embodiment is a ring cylinder of which the sectional view is in a ring shape. The outer ring sleeve 120 is sleeved on the inner lining body 110 and wraps the gas flow channels 118. The outer ring sleeve 120 has a plurality of micro-pores in communication with the gas flow channels 118. Specifically, in this embodiment or other embodiments, the material of the outer ring sleeve 120 may be a porous material. For example, the outer ring sleeve 120 may be made of a porous ceramic substrate, a powder-sintered metal complex, fiber woven material, or a porous polymer material. Therefore, due to the property of the porous material, i.e. the outer ring sleeve 120 with a plurality of micro-pores inside, gas can pass through the outer ring sleeve 120 through the micro-pores. The suction-type transmission apparatus is configured to contact with the flexible substrate 90 through the outer ring sleeve 120 of the suction wheel member, and suck the flexible substrate 90 thereon by means of the micro-pores on the outer ring sleeve 120.

Furthermore, in this embodiment or other embodiments, the inner lining body 110 has flanges 114 at two opposite ends respectively, and the outer ring sleeve 120 is disposed between the two flanges 114. The flanges 114 of the inner lining body 110 are laminated to the contact disk 220 of the suction region allocation member 200. The gas hole 116 is located on the flange 114; and the gas holes 116 run through the flange 114. When the inner lining body 110 rotates with respect to the contact disk 220, the gas holes 116 may overlap the through holes 222 on the contact disk 220, so that the gas flow channels 118 is communicated with the chamber 212 through the gas holes 116 and the through holes 222.

Moreover, in this embodiment or some embodiments, the suction-type transmission apparatus 10 comprises at least one suction region allocation member 200. In the drawing of this embodiment, the suction-type transmission apparatus 10 having two suction region allocation members 200 is taken as an example, but the disclosure is not limited thereto. The two suction region allocation members 200 are respectively disposed at two opposite sides of the inner lining body 110, and laminated to flanges 114 at two opposite sides of the inner lining body 110. Through such a structure configuration, the suction wheel member 100 is enabled to have an even and strong suction performance.

Furthermore, the chamber 212 of the suction region allocation member 200 may be connected to at least one gas extraction joint 216. The gas extraction joint 216 has a gas extraction port 2161. The number of the gas extraction-joints 216 is not intended to limit the disclosure. In other embodiments, the number of the gas extraction joints 216 may be greater than one. The gas extraction joint 216 is connected to a gas discharge device (not shown) through the gas extraction port 2161. The gas discharge device evacuates the air in the suction region allocation member 200, so as to make the pressure in the chamber 212 be negative. The gas flow channels 118 are in communication with the chamber 212 so the pressure in the gas flow channels 118 are also negative. In this way, due to the negative pressure in the gas flow channels 118, the micro-pores on the outer ring sleeve 120 that are in communication with the gas flow channels 118 is capable of sucking things. When the flexible substrate 90 is transferred on the outer ring sleeve 120, it is hold and sucked by the outer ring sleeve 120. Accordingly, the flexible substrate 90 can move stably with respect to the outer ring sleeve 120. Moreover, the pores on the outer ring sleeve 120 are very small so during that the outer ring sleeve 120 sucks the flexible substrate 90, the surface of the flexible printed circuit 90 board will not be deformed.

Furthermore, at least one sealing element 230 may be selectively disposed in the chamber 212 of the suction region allocation member 200 to seal at least one of the through holes 222. While the suction wheel member 100 rotates, the gas hole 116 aligned with the through hole 222 which is sealed by a sealing element 230 cannot be in communicated with the chamber 212. In this way, the gas flow channel 118 in communication with the gas hole 116 cannot be in communication with the chamber 212, and the pressure in the gas flow channel 118 does not remain negative. Accordingly, the portion of the outer ring sleeve 120 located above the gas flow channel 118 in which the pressure does not remain negative can not suck and therefore, hold the flexible substrate 90 temporarily.

Therefore, by appropriately using the sealing element 230 to seal the through holes 222 on the contact disk 220, the position and scope of the suction region of the outer ring sleeve 120 on the suction wheel member 100 is adjustable. For example, the through holes 222 may be disposed on the contact disk 220 at an regular angle interval around the rotating shaft 130, and the angle interval may be an angle of 15 degrees, so the contact disk 220 has 24 through holes 222, as shown in FIG. 2B. When all the through holes 222 on the contact disk 220 are not sealed by the sealing element 230, all the region of the outer ring sleeve 120 of the suction wheel member 100 have the ability to suck things. That is to say, all the regions surrounding the outer ring sleeve 120 at full 360 degrees have the holding effect. In contrast, when all the through holes 222 on the contact disk are sealed by the sealing element 230, all the regions of the outer ring sleeve 120 of the suction wheel member 100 do not have the holding effect. If one of the through holes 222 is not sealed by the sealing element 230, the holding effect within a scope of fifteen degrees on the outer ring sleeve 120 is provided. Therefore, sealing elements 230 may be appropriately used to seal some through holes 222, so that a user can adjust the scope and position of the suction angle region of the suction wheel member 100, for example, but not limited to, a suction region of 90 degrees on the upper portion of the suction wheel member 100 and a suction region of 120 degrees lower portion of the same.

Furthermore, in this embodiment and some embodiments, the suction-type transmission apparatus 10 may further comprise a bearing module 300. The bearing module 300 comprises at least one bearing 310. Optionally, the bearing module 300 may further comprise a fixing cover 320. The side housing 210 of the suction region allocation member 200 may further have a through slot 211 at the center thereof. The chamber 212 surrounds the through slot 211. The bearing 310 is accommodated in the slot 211, and the rotating shaft 130 is inserted into the bear 310. The fixing cover 320 is fixed to the side housing 210 through a locking element 330 and covers the through slot 211, so as to fix the bear 310 in the through slot 211. Moreover, in this embodiment, the suction wheel member 100 is inserted into the bearing 310 through the rotating shaft 130 and is pivoted to the suction region allocation member 200.

Furthermore, in this embodiment, the side housing 210 of the suction region allocation member 200 is further connected to a gas inlet joint 218 and a connection tube 2182 that is disposed in the chamber 212. The gas inlet joint 218 has a gas inlet 2181. The gas inlet joint 218 is connected to a gas inlet device (not shown) through the gas inlet 2181. The connection tube 2182 communicates the gas inlet 2181 with one of the through holes 222, so that the gas inlet 2181 is not in communication with the chamber 212, and the gas inlet device is merely configured to discharge gas in the gas flow channel 118 which is rotated to align with connection tube 2182. Furthermore, when the chamber 212 is in an negative pressure state to enable the suction wheel member 100 to perform a suction action on the outer ring sleeve 120 of the suction wheel member 100, dust and suspended particles in the air may be sucked in and block the micro-pores on the outer ring sleeve 120, and as a result, the suction performance of the suction wheel member 100 deteriorates. Therefore, by rotating the gas flow channel 118 to communicate the gas inlet joint 218 through the connection tube 2182, the gas inlet device can discharge gas in the gas flow channel 118 so as to remove the dust and particles that are blocked on the micro-pores on the outer ring sleeve 120. In this way, it is ensured that the suction wheel member 110 remains a good suction performance.

It should be noted that the feature that the suction region allocation member 200 of this embodiment has a gas inlet 2181 is not intended to limit the disclosure. In other embodiments, the gas extraction port 2161 may be connected to a gas discharge device and a gas inlet device at the same time, so that the chamber 212 can selectively generate a negative pressure or a positive pressure therein. Therefore the suction wheel member 100 can suck things when the chamber 212 has a negative pressure. Or, the suction wheel member can making things floating on it or discharge gas when the chamber 212 has a positive pressure, thereby achieving self-cleaning function. Furthermore, a gas inlet device and a gas discharge device are connected to the suction wheel member 100 at the same time through the gas extraction port 2161, the suction wheel member 100 can sucking things or make things floating on it.

Figure 3A:
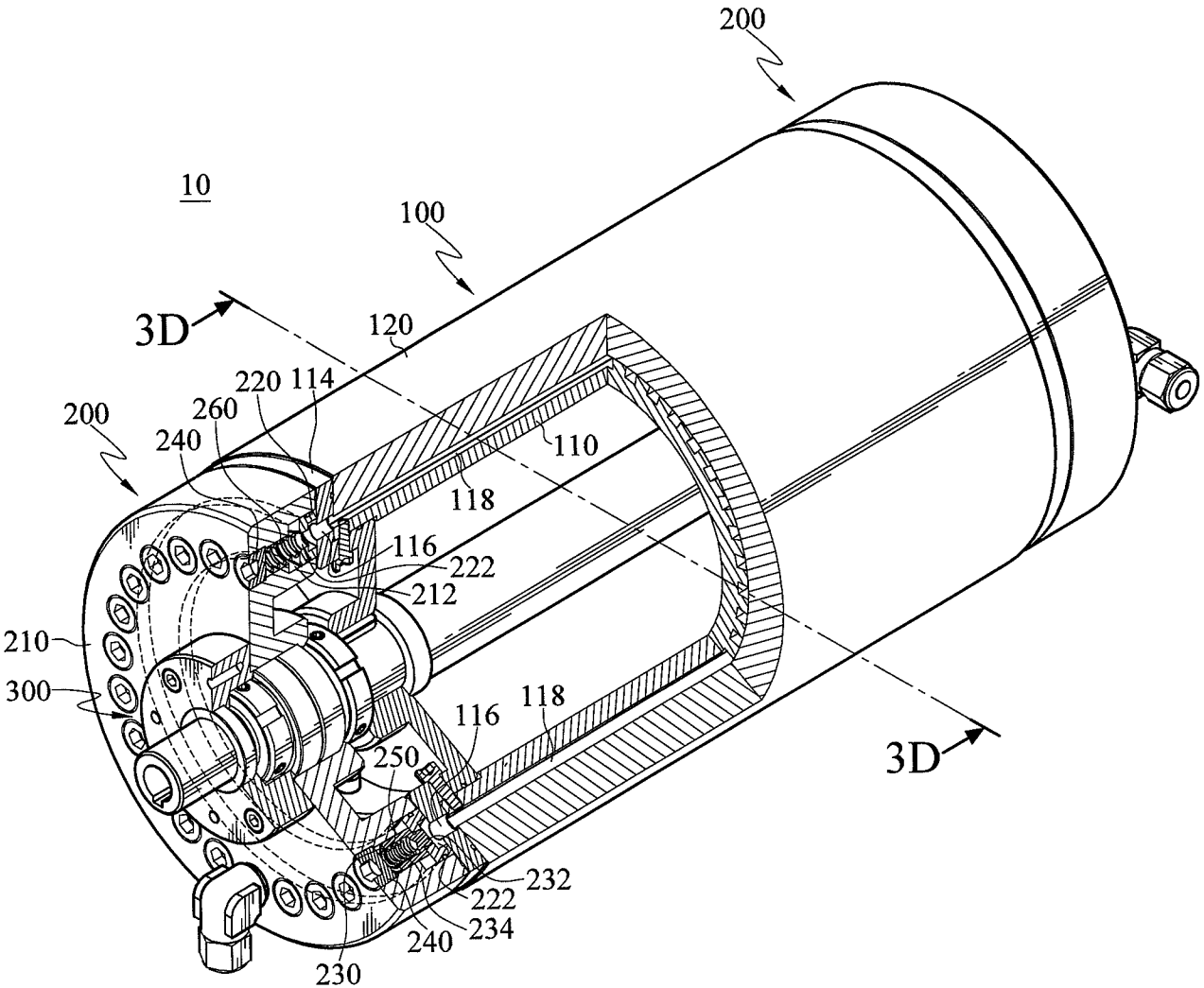
FIG. 3A is a cross-sectional view of a partial structure of a suction-type transmission apparatus according to an embodiment of the disclosure.
Figure 3B:
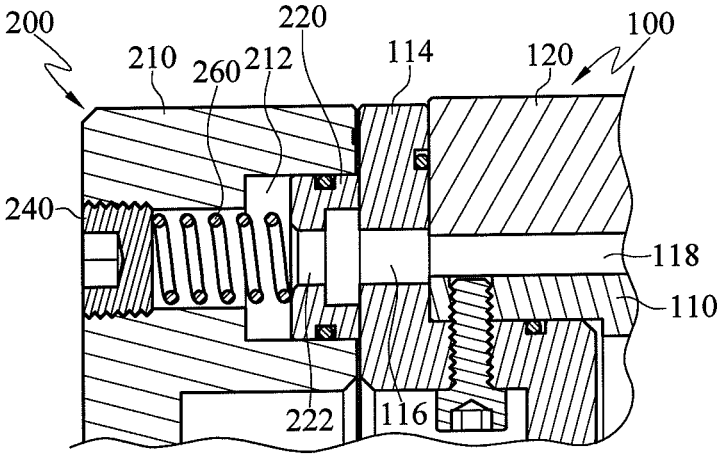
FIG. 3B is a schematic plan view of a partial structure of a suction-type transmission apparatus when through holes are not sealed according to an embodiment of the disclosure.
Figure 3C:
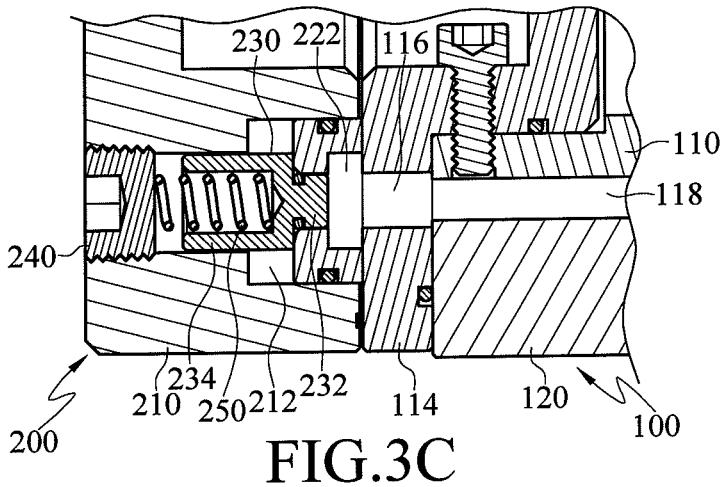
FIG. 3C is a schematic plan view of a partial structure of a suction-type transmission apparatus when through holes are sealed according to an embodiment of the disclosure.
Figure 3D:
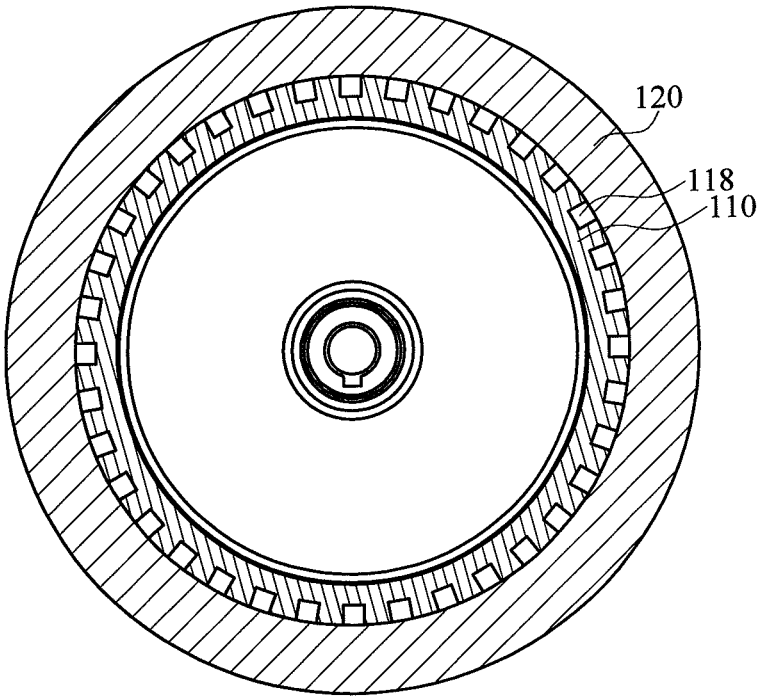
FIG. 3D is a cross-sectional view of a structure of the suction-type transmission apparatus in FIG. 3A along a 3D cross-sectional line.

Reference is made to FIG. 2B, and FIG. 3A to FIG. 3D together. FIG. 3A is a cross-sectional view of a partial structure of a suction-type transmission apparatus according to an embodiment of the disclosure; FIG. 3B is a schematic plan view of a partial structure of a suction-type transmission apparatus when through holes are not sealed according to an embodiment of the disclosure; FIG. 3C is a schematic plan view of a partial structure of a suction-type transmission apparatus when through holes are sealed according to an embodiment of the disclosure; and FIG. 3D is a cross-sectional view of a partial structure of the suction-type transmission apparatus in FIG. 3A along a 3D cross-sectional line.

Next, the detailed structures of a sealed state when the through holes 222 are sealed by the sealing element 230 and an open state when the through holes 222 are not sealed by the sealing element 230 in this embodiment are described in the following. In this embodiment or other embodiments, the side housing 210 further has a plurality of lock holes 214. The suction region allocation member 200 further comprises a plurality of nuts 240 that are screwed to the lock holes 214. When the through holes 222 are in the sealed state, the nuts 240 are locked to the lock hole 214 and push the sealing element 230, so that the sealing element 230 is disposed between the nuts 240 and the contact disk 220, as shown in FIG. 3C. When the through holes 222 are in the open state, the nut 240 is locked to the lock hole 214, and the through holes 222 are not blocked by any object between the nut 240 and the contact disk 220, as shown in FIG. 3B.

Moreover, in this embodiment and some embodiments, the chambers 212 may have a plurality of elastic elements 250 and a plurality of elastic elements 260 therein, and the elastic elements 250 and the elastic elements 260 may be springs. The number of the elastic elements 250 corresponds to the number of the sealed through holes 222; and the number of the elastic elements 260 corresponds to the number of the through holes 222 that are not sealed. The elastic elements 250 are disposed between the nut 240 and the sealing element 230 (as shown in FIG. 3C). The elastic elements 260 are disposed between the nuts and the contact disk 220 (as shown in FIG. 3B). The elastic elements 250 apply a force on the contact disk 220 through the sealing element 230; and the elastic elements 260 directly apply a force on the contact disk 220. In this way, the contact disk 220 can be closely laminated to the flanges 114 under an elastic force applied by the elastic elements 250 and the elastic elements 260, so as to prevent a gap from being generated between the flanges 114 and the contact disk 220. Accordingly, the problem of gas leakage is prevented.

Figure 6:
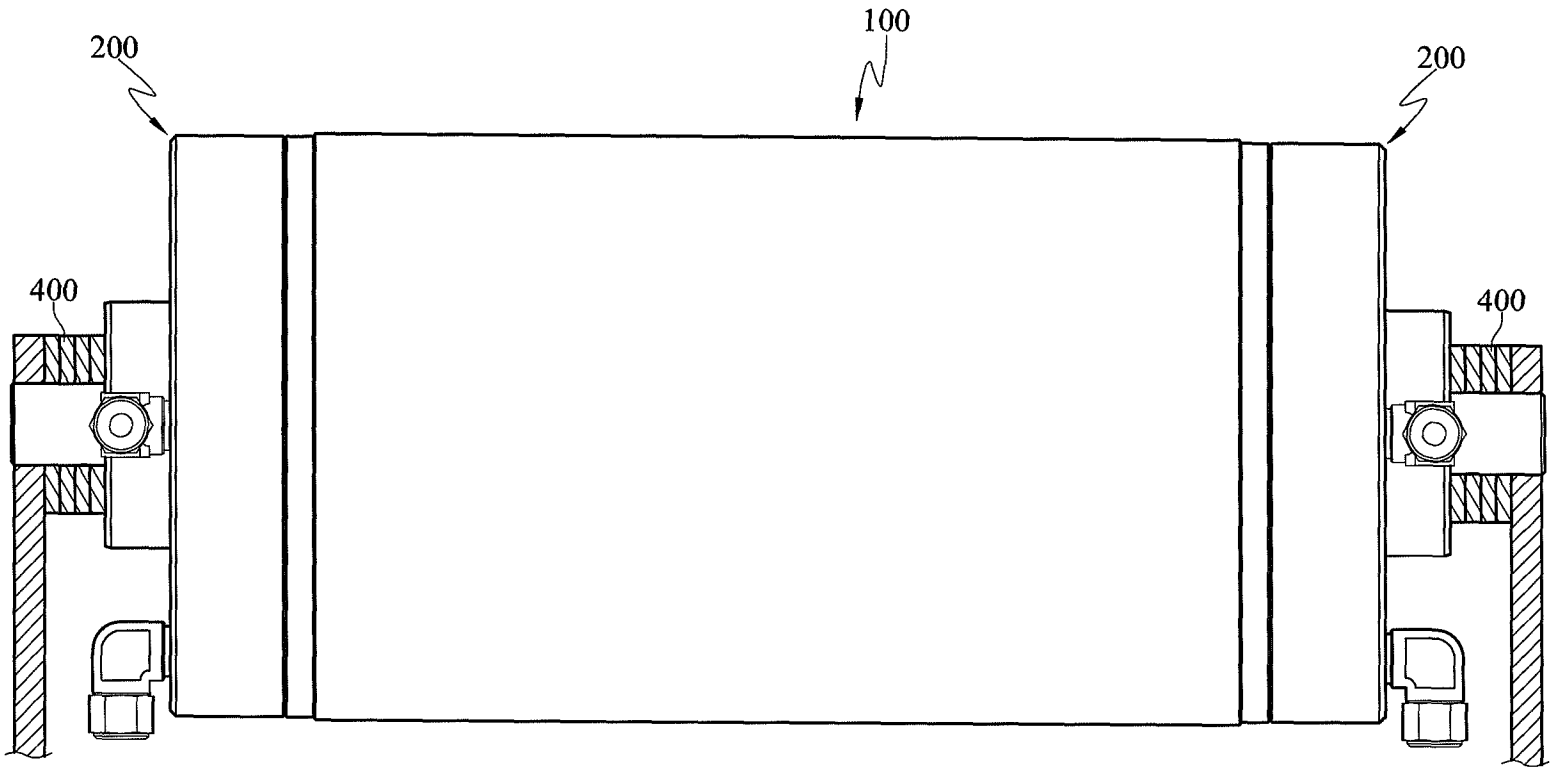
FIG. 6 is a schematic assembled structural view of a suction-type transmission apparatus according to another embodiment of the disclosure.

It should be noted that, in the suction-type transmission apparatus 10 of this embodiment, the plurality of elastic elements 250 and the plurality of elastic elements 260 are disposed in the chamber 212 to apply pushing forces for the contact disks 220 to be closely laminated to the flanges 114, but the structural feature for avoiding gas leakage is not intended to limit the disclosure. For example, as shown in FIG. 6, the suction-type transmission apparatus 10 also comprises an elastic element 400. The elastic element 400 is disposed at a side of the suction region allocation member 200, so that the suction region allocation member 200 is disposed between the elastic element 400 and the suction wheel member 100. In this way, the elastic element 400 may apply a pushing force on the suction region allocation member 200, so that the contact disk 220 of the suction region allocation member 200 can be laminated to the flanges 114 of the suction wheel member 100 as closely as possible. Accordingly, the problem of gas leakage is prevented.

Figure 4A:
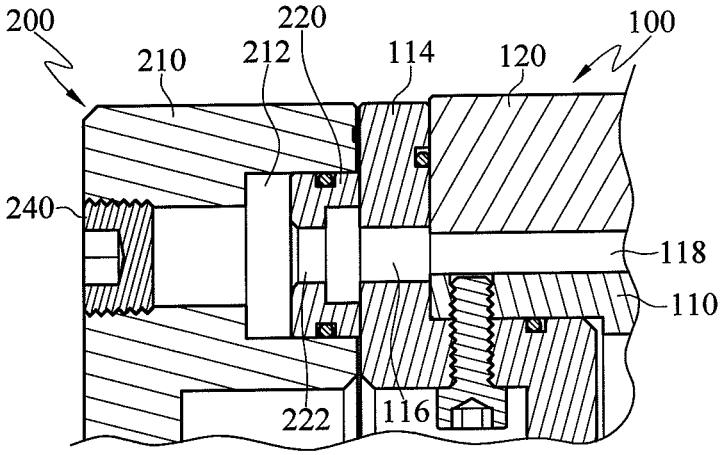
FIG. 4A is a schematic plan view of a partial structure of a suction-type transmission apparatus when through holes are not sealed according to another embodiment of the disclosure.

Furthermore, in this embodiment, when the through holes 222 are in an open state (as shown in FIG. 3B), the elastic elements 260 are disposed between the contact disk 220 and the nut 240, but the feature is not intended to limit the disclosure. For example, in other embodiments, when the through holes 222 are in an open state, no elastic element 260 is disposed between the contact disk 220 and the nuts 240, as shown in FIG. 4A.

Figure 4B:
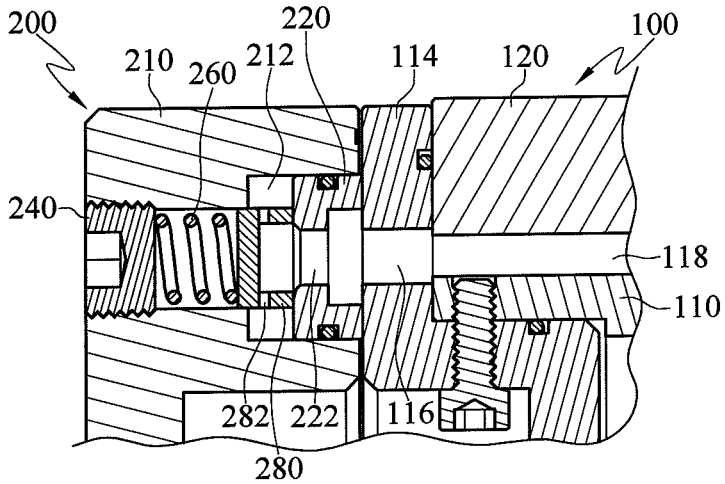
FIG. 4B is a schematic plan view of a partial structure of a suction-type transmission apparatus when through holes are not sealed according to still another embodiment of the disclosure.

Or, in other embodiments, when the through holes 222 are in an open state, a pushing element 280 may be further disposed between the elastic elements 260 and the contact disk 220, as shown in FIG. 4B. The pushing element 280 has a perforation 282. The perforation 282 is in communication with the chamber 212 and the through holes 222.

Figure 5A:
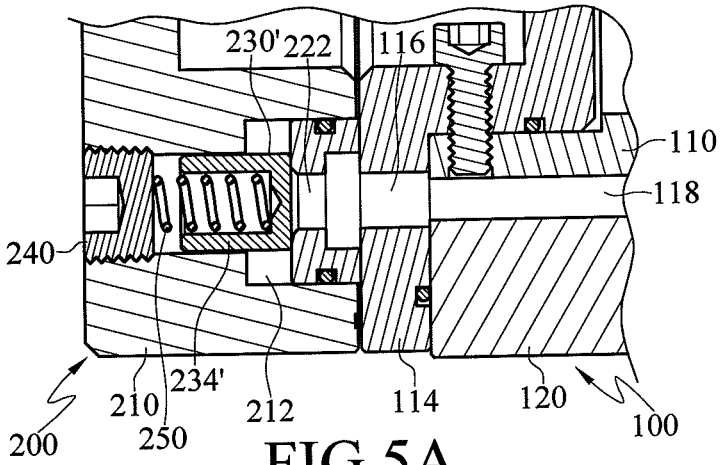
FIG. 5A is a schematic plan view of a partial structure of a suction-type transmission apparatus when through holes are sealed according to another embodiment of the disclosure.

Furthermore, in this embodiment, the sealing element 230 has a protruding post 232 and a ring side wall 234 at two opposite ends respectively, as shown in FIG. 3C. The protruding posts 232 are located in the through holes 222; and the ring side wall 234 wraps at least a part of the elastic elements 250. However, the feature of the sealing element 230 of this embodiment is not intended to limit the disclosure. In other embodiments of the disclosure, a sealing element 230' may have a ring side wall 234' that wraps at least partial of the elastic elements 250 at one side, but the sealing element 230' does not have a protruding post 232 that is located in the through holes 222 at the other side, as shown in FIG. 5A.

Figure 5B:
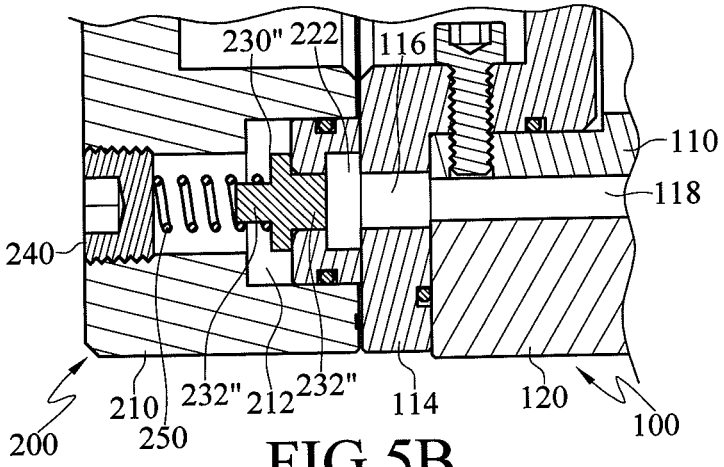
FIG. 5B is a schematic plan view of a partial structure of a suction-type transmission apparatus when through holes are sealed according to still another embodiment of the disclosure.

Or, referring to FIG. 5B, in the embodiments of the disclosure, a sealing element 230" has a protruding post 232" on two opposite ends respectively. One of the protruding posts 232" is located in the through holes 222, and the other protruding post 232" is inserted into the elastic elements 250.

Figure 5C:
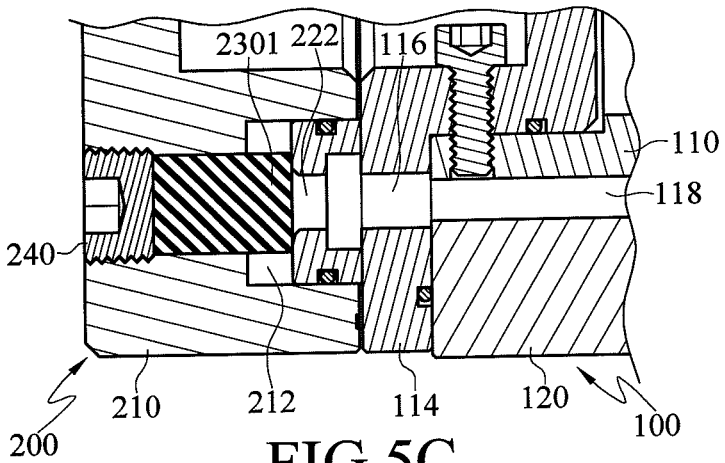
FIG. 5C is a schematic plan view of a partial structure of a suction-type transmission apparatus when through holes are sealed according to still another embodiment of the disclosure.

Or, referring to FIG. 5C, in other embodiments of the disclosure, a sealing element 2301 may be an elastic body such as a rubber block. The sealing element 2301 is disposed between the nut 240 and the contact disk 220. The sealing element 2301 may provide an elastic force for pushing the contact disk 220, so that the contact disk 220 can be closely laminated to the flanges 114.

Figure 7:
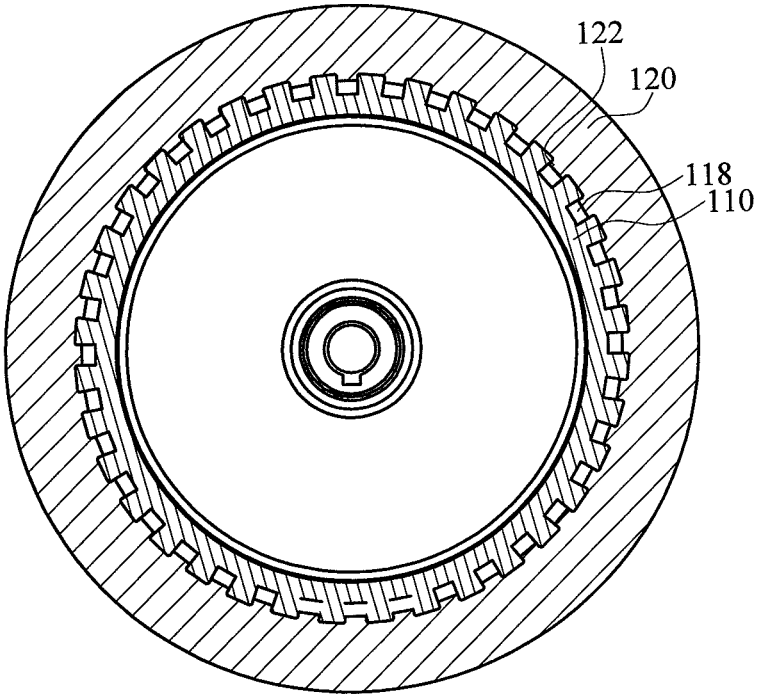
FIG. 7 is a cross-sectional view of a structure of a suction-type transmission apparatus according to another embodiment of the disclosure.

Next, reference is made to FIG. 3D. In this embodiment, no structure is disposed between the outer ring sleeve 120 and the inner lining body 110 to restrain the rotation of the outer ring sleeve 120 with respect to the inner lining body 110. In fact, the outer ring sleeve 120 of this embodiment is fixed in the inner lining body 110 in an adhesion manner, but his feature is not intended to limit the disclosure. In other embodiments, as shown in FIG. 7, the outer ring sleeve 120 has a plurality of positioning ribs 122 on the ring inner wall. The positioning ribs are engaged with a part of space of a gas flow channel 118 respectively, so as to restrain the rotation of the outer ring sleeve 120 relative to the inner lining body 110. Moreover, through the design that the positioning ribs 122 are engaged with the gas flow channels 118, the outer ring sleeve 120 can be conveniently assembled to or disassembled from the inner lining body 110. Accordingly, it is convenient for replacing the outer ring sleeve 120 with different sizes on the inner lining body 110, and also enables the suction wheel member 110 to meet different requirements.

In the suction-type transmission apparatus according to the forgoing embodiments, a sealing element is alternatively disposed in the chamber to seal some through holes, so as to configure a suction region scope for the suction wheel member. Accordingly, the suction angle of the suction wheel member is adjustable. In this way, when the suction-type roller is applied in roll-to-roll processing equipment, the suction angle may be adjusted after installation, thereby meeting various application requirements.

Furthermore, since the outer ring sleeve is made of a porous material which has, a plurality of micro-pores, the manufacturing cost is reduced. Additionally, the holes on the outer ring sleeve are very small, so while the outer ring sleeve sucks the flexible substrate, the surface of the flexible substrate will not be deformed.

In addition, the inner lining body may be made of metal, so that the gas flow channels on the inner lining body can be easily formed, thereby reducing the manufacturing cost. Furthermore, a gas inlet device and a gas discharge device are connected to the suction wheel member at the same time through the gas discharge port, and the suction wheel member can achieve a vacuum suction and floatation effect at the same time, thereby meeting various practical application requirements.

What is claimed is:

1. A suction-type transmission apparatus, comprising:

at least one suction region allocation member, comprising a side housing, a contact disk and a plurality of nuts, a side of the side housing curved inward to form a ring groove, the side housing has a plurality of lock holes, the contact disk laminated to a side of the side housing and covering the ring groove to form a chamber, and through holes running through the contact disk, the at least one suction region allocation member further having the plurality of through holes in communication with the chamber, and the plurality of nuts locked to the lock holes;

a suction wheel member, comprising: a rotating shaft, pivoted to the suction region allocation member; an inner lining body, disposed on the rotating shaft, and laminated to the suction region allocation member, the contact disk laminated to the inner lining body at a side opposite to the side housing, the inner lining body having a plurality of gas flow channels that are disposed in parallel, the inner lining body having a plurality of gas holes corresponding to the through holes at a side thereof, the gas holes being disposed around the rotating shaft, and the gas holes being in communication with the gas flow channels; and an outer ring sleeve, sleeved on the inner lining body, and wrapping the gas flow channels, wherein the outer ring sleeve has a plurality of micro-pores in communication with the gas flow channels;

wherein the chamber is connected to a gas extraction port, at least one sealing element is configured to be selectively disposed in the chamber to seal at least one of the through holes, so as to form a suction region of the suction wheel member, and one of the nuts is for pushing the sealing element for clipping the sealing element with the contact disk.

2. The suction-type transmission apparatus according to claim 1, wherein the outer ring sleeve has a plurality of positioning ribs on a ring inner wall, and the positioning ribs being respectively located at the gas flow channels.

3. The suction-type transmission apparatus according to claim 1, wherein the inner lining body has a flange at a side, the suction region allocation member being laminated to the flange, and the gas holes run through the flange.

4. The suction-type transmission apparatus according to claim 1, wherein the number of the at least one suction region allocation member is two, and the two suction region allocation members being respectively laminated to two opposite sides of the inner lining body.

5. The suction-type transmission apparatus according to claim 1, wherein the suction region allocation member further comprises an elastic element, disposed between the nut and the contact disk.

6. The suction-type transmission apparatus according to claim 1, wherein an end of the sealing element has a protruding post located in the through hole.

7. The suction-type transmission apparatus according to claim 1, wherein the sealing element is made of an elastic material.

8. The suction-type transmission apparatus according to claim 1, wherein the suction region allocation member further comprises a gas inlet and a connection tube disposed inside of the chamber, the connection tube communicating the gas inlet to one of the through holes for discharging gas from one of the gas flow channels.

9. The suction-type transmission apparatus according to claim 1, further comprising a bearing module, disposed at the suction region allocation member, and penetrating the bearing module.

10. The suction-type transmission apparatus according to claim 1, further comprising an elastic element, disposed at a side of the suction region allocation member, and the suction region allocation member being disposed between the elastic element and the suction wheel member.

11. The suction-type transmission apparatus according to claim 1, wherein the outer ring sleeve is made of a porous material.

12. The suction-type transmission apparatus according to claim 11, wherein the porous material is porous ceramic, a powder-sintered metal complex, fiber woven material, or porous polymer.

13. The suction-type transmission apparatus according to claim 1, wherein the suction region allocation member further comprises an elastic element, disposed between the nut and the sealing element.

14. The suction-type transmission apparatus according to claim 13, wherein an end of the sealing element has a protruding post penetrating the elastic element.

15. The suction-type transmission apparatus according to claim 13, wherein an end of the sealing element has a ring side wall, covering at least a part of the elastic element.

* * * * *